US007654649B2

(12) United States Patent
Sugahara

(10) Patent No.: US 7,654,649 B2
(45) Date of Patent: Feb. 2, 2010

(54) LIQUID DELIVERING DEVICE

(75) Inventor: Hiroto Sugahara, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 11/167,361

(22) Filed: Jun. 28, 2005

(65) Prior Publication Data

US 2005/0285911 A1 Dec. 29, 2005

(30) Foreign Application Priority Data

Jun. 29, 2004 (JP) ..... 2004-191156

(51) Int. Cl.
*B41J 2/045* (2006.01)
*B41J 2/17* (2006.01)

(52) U.S. Cl. ..... 347/68; 347/94

(58) Field of Classification Search ..... 347/70–72, 347/94

See application file for complete search history.

(56) References Cited

U.S. PATENT DOCUMENTS

| | | | | |
|---|---|---|---|---|
| 5,594,292 | A | 1/1997 | Takeuchi et al. | |
| 5,637,126 | A * | 6/1997 | Ema et al. | 65/31 |
| 5,784,085 | A | 7/1998 | Hosono et al. | |
| 5,856,837 | A | 1/1999 | Kitahara et al. | |
| 5,956,829 | A | 9/1999 | Kitahara et al. | |
| 6,334,673 | B1 | 1/2002 | Kitahara et al. | |
| 6,796,638 | B2 | 9/2004 | Koike et al. | |
| 2003/0025768 | A1 * | 2/2003 | Koike et al. | 347/68 |
| 2005/0068377 | A1 * | 3/2005 | Ishikawa et al. | 347/68 |

FOREIGN PATENT DOCUMENTS

| | | | |
|---|---|---|---|
| JP | 58-108163 | A | 6/1983 |
| JP | 3284950 | A | 12/1991 |
| JP | 4028557 | A | 1/1992 |
| JP | 7-60960 | | 3/1995 |
| JP | 7156384 | A | 6/1995 |
| JP | 7202284 | A | 8/1995 |
| JP | 8-150716 | | 6/1996 |
| JP | 11-334087 | | 12/1999 |
| JP | 2000-37868 | | 2/2000 |
| JP | 2001150687 | A | 6/2001 |
| JP | 2001179963 | A | 7/2001 |
| JP | 2003298132 | A | 10/2003 |
| JP | 2004066652 | A | 3/2004 |
| WO | WO 01/74591 | | 10/2001 |

OTHER PUBLICATIONS

Office Action in corresponding Japanese Application No. 2003-109701.

* cited by examiner

*Primary Examiner*—Matthew Luu
*Assistant Examiner*—Lisa M Solomon
(74) *Attorney, Agent, or Firm*—Banner & Witcoff, Ltd

(57) ABSTRACT

A liquid delivering device including: a flow passage unit having a plurality of pressure chambers each of which communicating with a liquid ejection port; a piezoelectric actuator for selectively changing the volume of the plurality of pressure chambers, the piezoelectric actuator including a plurality of individual electrodes corresponding to the plurality of pressure chambers, a common electrode opposing the plurality of individual electrodes, and a piezoelectric layer sandwiched between the plurality of individual electrodes and the common electrode; and a rigidity reduction section which reduces the rigidity of the piezoelectric actuator and which is provided in an area where at least the pressure chamber is formed and in a vicinity of the individual electrode, in perspective plan view.

22 Claims, 14 Drawing Sheets

LIQUID DELIVERING DEVICE

BACKGROUND OF THE INVENTION

1. Field of the Invention

The present invention relates to a liquid delivering device such as an inkjet head which effects recording on a recording medium by means of ejecting ink on the same.

2. Description of the Related Art

An inkjet head, which has hitherto been known, has a piezoelectric actuator which deforms a piezoelectric layer by subjecting the piezoelectric layer to an electric field, and ink is ejected by application of pressure, by means of the piezoelectric actuator, to the ink stored in a pressure chamber (see JP-A-11-334087 (see FIG. 3)). The inkjet head piezoelectric actuator disclosed in JP-A-11-334087 is a unimolf-type piezoelectric actuator including a diaphragm which also functions as a lower electrode (a common electrode); a piezoelectric layer formed from lead zirconate titanate (PZT) or the like made on the surface of the diaphragm; and a plurality of upper electrodes (individual electrodes) formed on the surface of the piezoelectric layer in correspondence with a plurality of pressure chambers. In this piezoelectric actuator, when a drive voltage is applied selectively to the plurality of upper electrodes, an electric field acts on the area of the piezoelectric layer sandwiched between the electrodes (a drive section) in a thicknesswise direction thereof, whereupon the drive section extends and contracts. In association with extension and contraction of the drive section, the piezoelectric layer and the diaphragm, which are located in the area opposing the pressure chamber, are deformed to thus apply pressure to the ink in the pressure chamber. The piezoelectric layer is formed continuously over the surface of the diaphragm across the plurality of pressure chambers by means of the sol-gel method, the reactive sputtering technique, the vacuum deposition method, or the like, whereby the piezoelectric layer corresponding to the plurality of pressure chambers is formed by one operation. The upper electrodes that cause the electric field to act on the piezoelectric layer are formed smaller than the pressure chamber, and the drive section assumes a size smaller than the pressure chamber. When the drive section extends or contracts upon exposure to the electric field, areas surrounding the drive section are also deformed in association with extension and contraction of the drive section. As a result, the piezoelectric layer and the diaphragm of the entire area opposing the pressure chamber are deformed.

SUMMARY OF THE INVENTION

However, if the piezoelectric layer is formed to a uniform thickness continuously across the plurality of pressure chambers, the rigidity of the piezoelectric actuator in the area opposing the pressure chambers (particularly, the area surrounding the drive section) becomes high, and the piezoelectric layer and the diaphragm of the entire area opposing the pressure chambers become less susceptible to deformation, thereby deteriorating the efficiency of deformation of the piezoelectric actuator. For this reason, there is a necessity for applying a high voltage to individual electrodes to thereby apply pressure to the ink in the pressure chambers, leading to an increase in power consumption at the time of ejection of ink.

The present invention provides a liquid delivering device which enables efficient deformation of the piezoelectric layer and the diaphragm of the piezoelectric actuator.

According to an aspect of the invention, there is provided a liquid delivering device including: a flow passage unit having a plurality of pressure chambers each of which communicating with a liquid ejection port; a piezoelectric actuator for selectively changing the volume of the plurality of pressure chambers, the piezoelectric actuator including a plurality of individual electrodes corresponding to the plurality of pressure chambers, a common electrode opposing the plurality of individual electrodes, and a piezoelectric layer sandwiched between the plurality of individual electrodes and the common electrode; and a rigidity reduction section which reduces the rigidity of the piezoelectric actuator and which is provided in an area where at least the pressure chamber is formed and in a vicinity of the individual electrode, in perspective plan view.

In this device, when a drive voltage is selectively supplied to the plurality of individual electrodes of the piezoelectric actuator, an electric field acts on areas of the piezoelectric layer sandwiched between the individual electrodes and the common electrode (hereinafter called "drive sections"), whereupon the drive sections extend or contract. Then, in association with extension and contraction of the drive sections, the piezoelectric layer and the diaphragm in the entire area opposing the pressure chambers are deformed, thereby changing the volumes of the pressure chambers.

A rigidity reduction section is provided in an area (i.e., an area surrounding the drive section) where the pressure chamber is formed and in the vicinity of the individual electrode when viewed in a direction orthogonal to a plane where the pressure chambers are provided. The rigidity of the piezoelectric actuator in the area surrounding the drive section is partially decreased by means of the rigidity reduction section. When the piezoelectric layer of the drive section has been deformed through extension and contraction, the piezoelectric layer and the diaphragm in the area opposing the pressure chamber become easy to deform in association with such deformation, thereby enabling efficient deformation of the piezoelectric actuator at a low voltage.

BRIEF DESCRIPTION OF THE DRAWINGS

The present invention may be more readily described with reference to the accompanying drawings.

DETAILED DESCRIPTION OF THE PREFERRED EMBODIMENTS

An embodiment of the present invention will be described. The present embodiment is an example in which the present invention is applied to a piezoelectric actuator used in an inkjet head.

Figure 1:
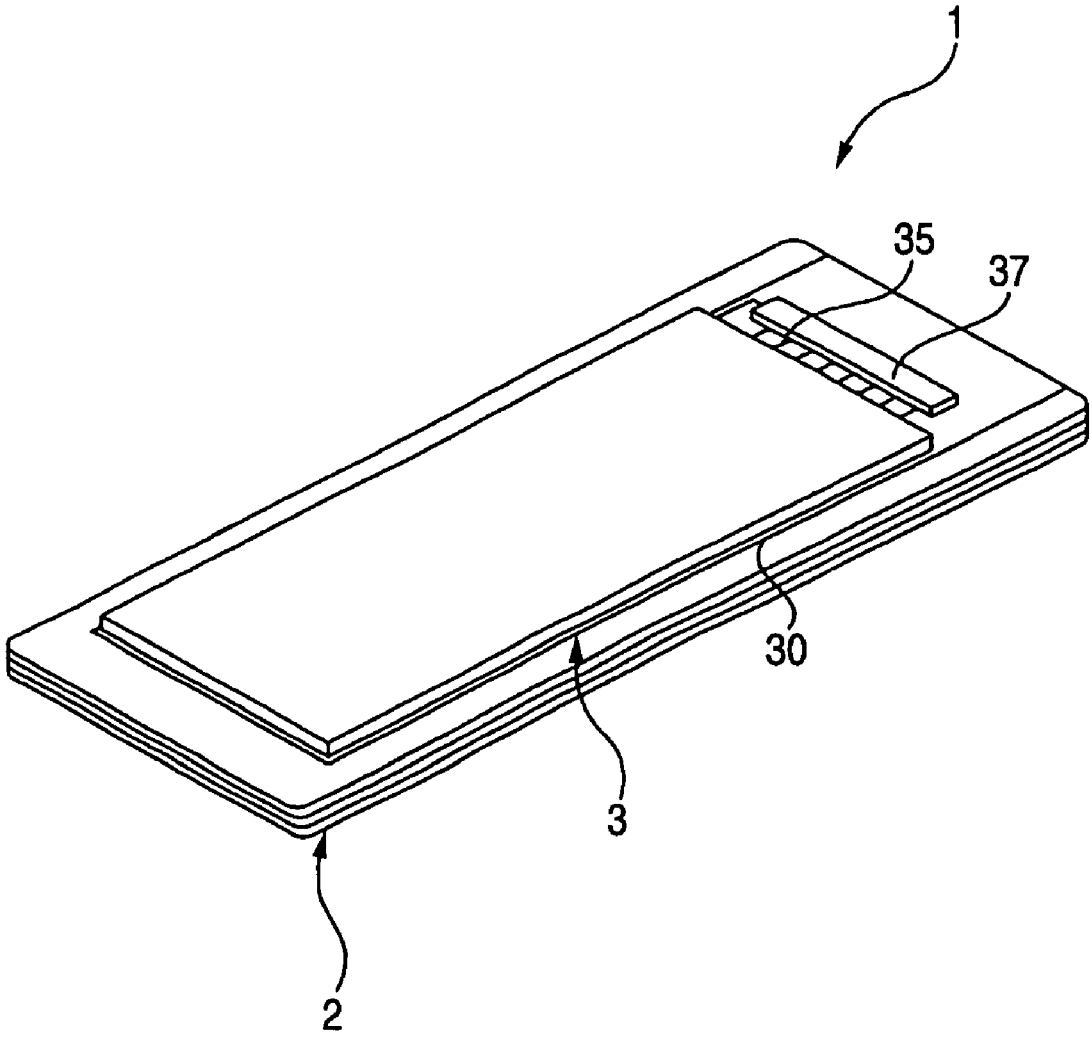
FIG. 1 is a perspective view of an inkjet head according to an embodiment of the present invention.

As shown in FIG. 1, an inkjet head 1 has a flow passage unit 2 in which ink flow passages are formed, and a piezoelectric actuator 3 stacked on an upper surface of the flow passage unit 2.

Figure 2:
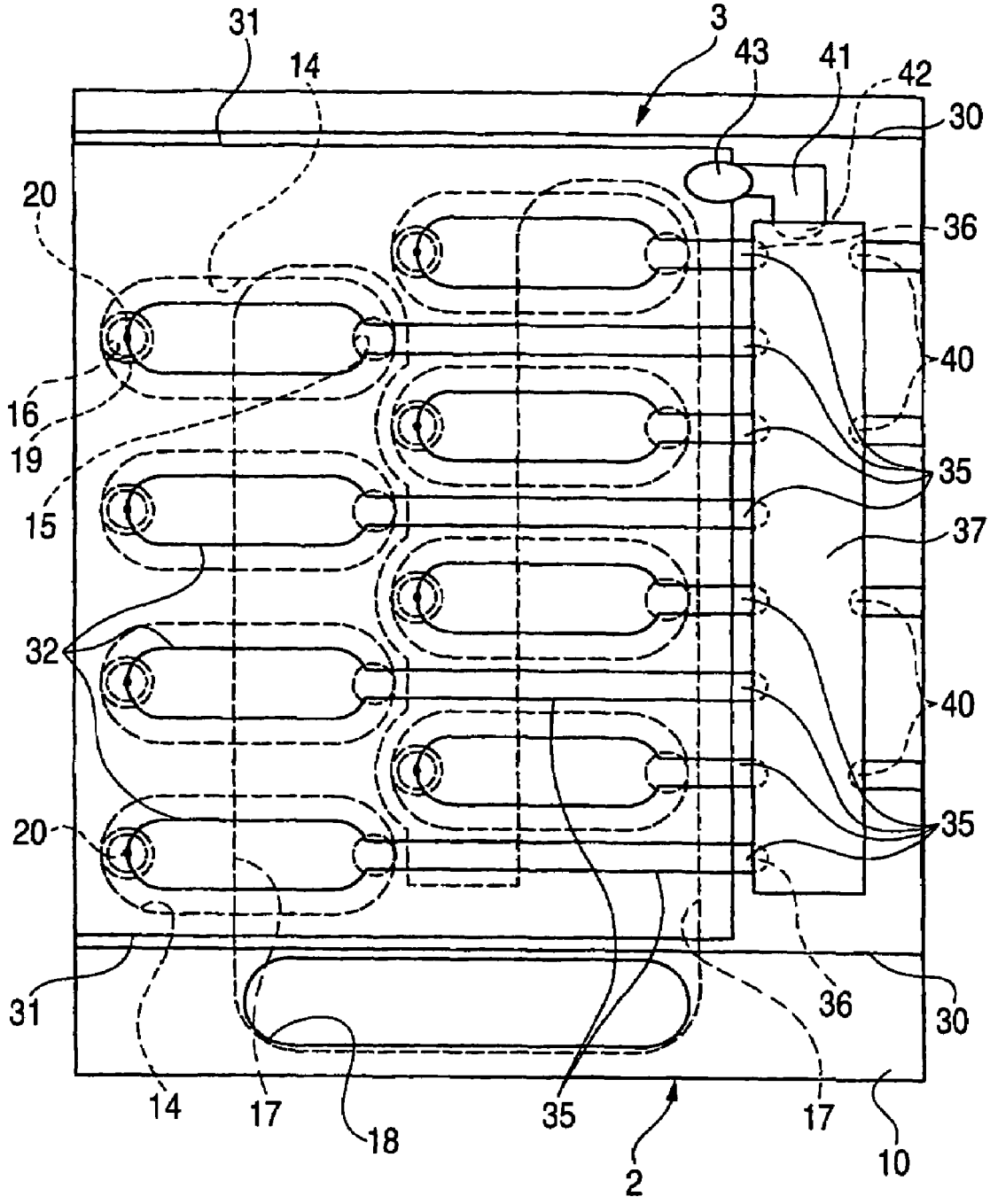
FIG. 2 is a plan view of a right-half portion of the inkjet head shown in FIG. 1.
Figure 3:
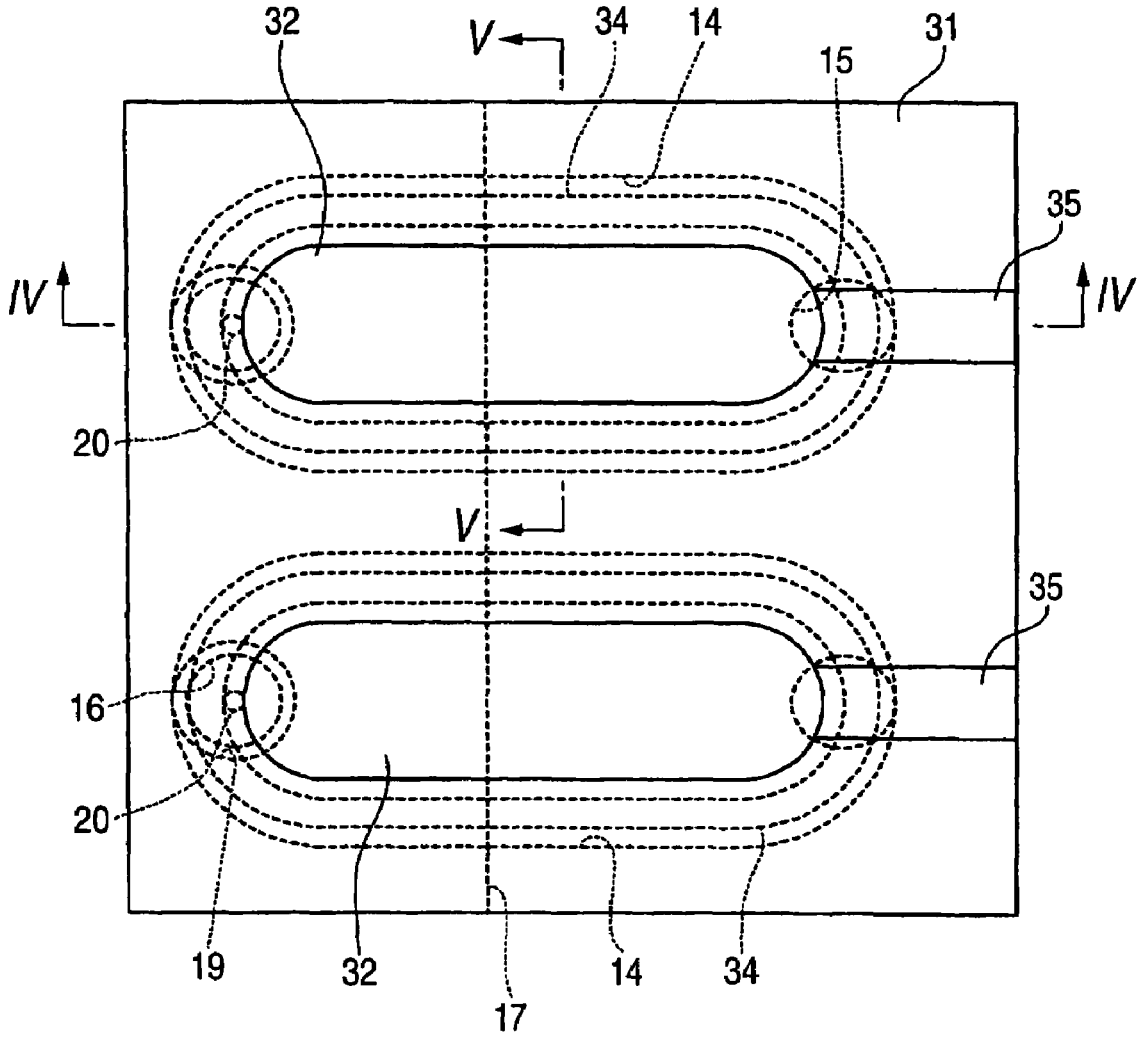
FIG. 3 is a fragmentary enlarged view of the inkjet head shown in FIG. 2.
Figure 4:
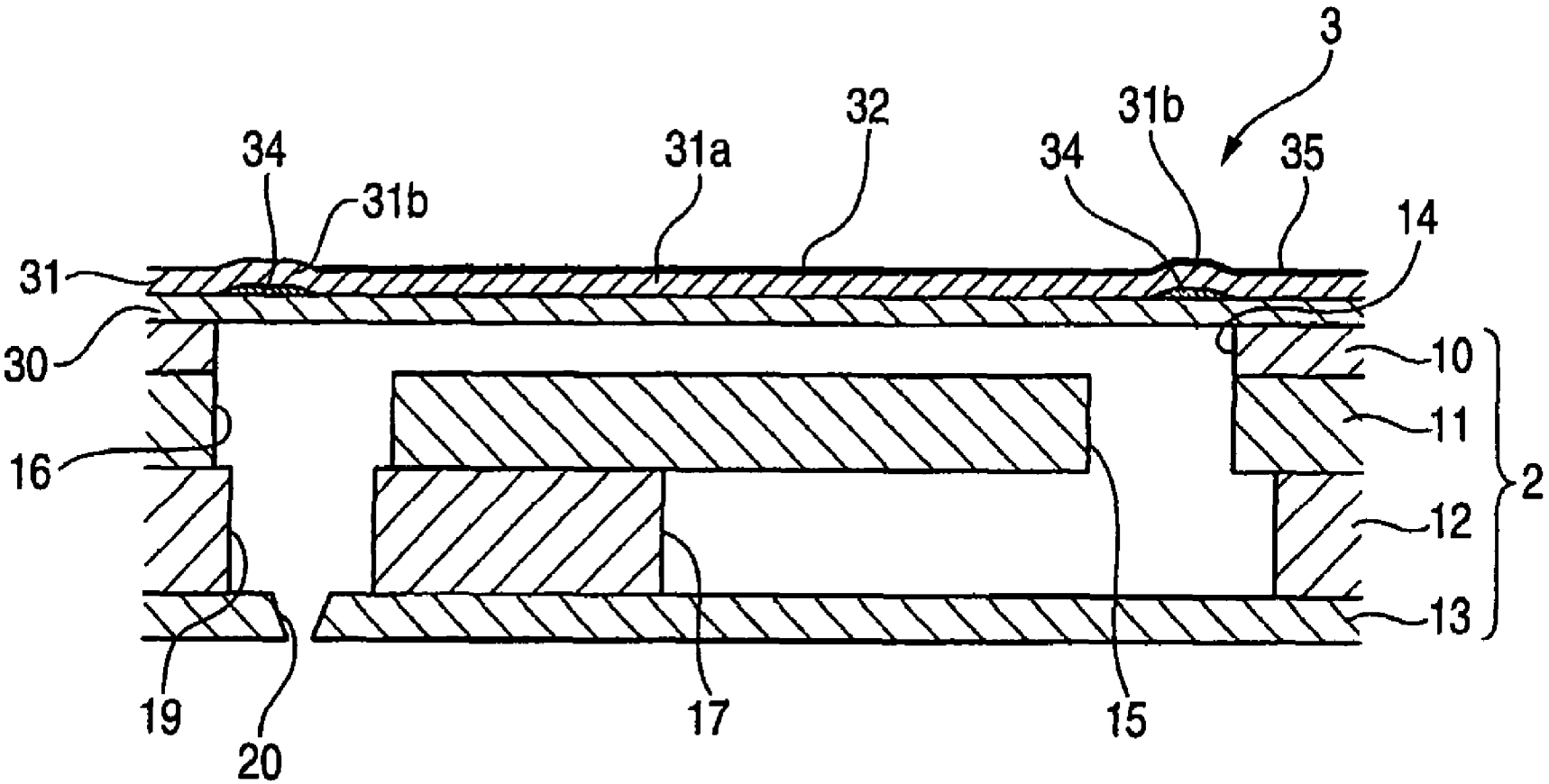
FIG. 4 is a cross-sectional view taken along line IV-IV shown in FIG. 3.
Figure 5:
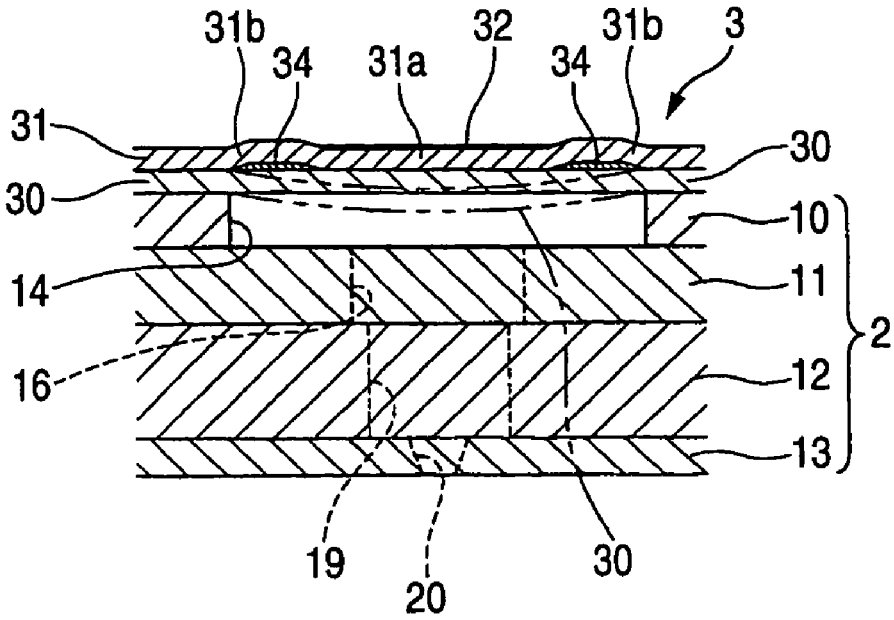
FIG. 5 is a cross-sectional view taken along line V-V shown in FIG. 3.

First, the flow passage unit 2 will be described. FIG. 2 is a schematic plan view of a right-side portion of the inkjet head 1 shown in FIG. 1. FIG. 3 is a fragmentary enlarged view of FIG. 2; FIG. 4 is a cross-sectional view taken along line IV-IV shown in FIG. 3; and FIG. 5 is a cross-sectional view taken along line V-V shown in FIG. 3. As shown in FIGS. 2 to 4, the flow passage unit 2 has a cavity plate 10, a base plate 11, a manifold plate 12, and a nozzle plate 13. These four plates 10 to 13 are bonded together in a stacked manner. Of these plates, the cavity plate 10, the base plate 11, and the manifold plate 12 are essentially rectangular plates made from stainless steel. Ink flow passages, such as a manifold 17 and a pressure chamber 14, which will be described later, can be readily formed in these three plates 10 to 12 by means of etching. The nozzle plate 13 is formed from, e.g., polymeric synthetic resin material, such as polyimide, and bonded to the lower surface of the manifold plate 12. Like the three plates 10 to 12, the nozzle plate 13 may also be formed from metal material such as stainless steel or the like.

As shown in FIG. 2, a plurality of pressure chambers 14 arranged along a plane are formed in the cavity plate 10. The plurality of pressure chambers 14 are opened in the surface of the flow passage unit 2 (the upper surface of the cavity plate 10 to which a diaphragm 30 to be described later is to be bonded). FIG. 2 shows some (eight) of the plurality of pressure chambers 14. The respective pressure chambers 14 are formed into an essentially oval shape in perspective plan view and are arranged such that the direction of the long axes of the pressure chambers is made parallel to the longitudinal direction of the cavity plate 10.

Communication holes 15, 16 are formed at positions of the base plate 11 which overlap the respective ends of the pressure chambers 14 in the direction of the major axis, in perspective plan view. The manifolds 17 are formed in the manifold plate 12, wherein the manifolds 17 are arranged in two rows in the lateral direction of the manifold plate 12 (i.e., the vertical direction in FIG. 2) and overlap right halves of the pressure chambers 14 shown in FIG. 2 in perspective plan view. Ink is supplied to the manifolds 17 from an ink tank (omitted from the drawings) by way of an ink supply port 18 formed in the cavity plate 10. Communication ports 19 are also formed in positions which overlap the left ends of the pressure chambers 14 in FIG. 2 in perspective plan view. Moreover, a plurality of nozzles 20 are formed at positions on the nozzle plate 13 which overlap the left ends of the plurality of pressure chambers 14 in perspective plan view. The nozzles 20 are formed by subjecting a substrate made of polymeric synthetic resin, e.g., polyimide, to excimer laser processing.

As shown in FIG. 4, the manifolds 17 are in mutual communication with the pressure chambers 14 by way of the communication ports 15, and the pressure chambers 14 are further in mutual communication with the nozzles 20 by way of the communication holes 16, 19. Individual ink flow passages extending from the manifolds 17 to the nozzles 20 by way of the pressure chambers 14 are formed in the flow passage unit 2.

Next, the piezoelectric actuator 3 will be described. As shown in FIGS. 1 through 5, the piezoelectric actuator 3 has the diaphragm 30, which is placed on the surface of the flow passage unit 2 and exhibits conductivity; a piezoelectric layer 31 formed continuously on the surface of the diaphragm 30 across the plurality of pressure chambers 14; and a plurality of individual electrodes 32 formed on the surface of the piezoelectric layer 31 in correspondence with the plurality of pressure chambers 14. The piezoelectric actuator 3 applies pressure to the ink in the pressure chamber 14 by selectively changing the volume of the plurality of pressure chambers 14.

The diaphragm 30 is a stainless steel plate assuming an essentially rectangular shape when viewed in plane, and is bonded, in a laminated manner, to the upper surface of the cavity plate 10 while closing apertures of the plurality of pressure chambers 14. The diaphragm 30 also functions as a common electrode which opposes the plurality of individual electrodes 32 and causes an electric field to act on the piezoelectric layer 31 interposed between the individual electrodes 32 and the diaphragm 30. Here, since the diaphragm 30 is made from stainless steel having a comparatively-high elastic modulus, the response of the piezoelectric actuator 3 is enhanced by the high rigidity of the diaphragm 30 when the piezoelectric layer 31 is deformed during ejecting operation of ink, as will be described later. The diaphragm 30 is bonded to the surface of the cavity plate 10 made from the same stainless steel as that of the diaphragm 30. Therefore, the diaphragm 30 and the cavity plate 10 become equal to each other in terms of a coefficient of thermal expansion, so that the bonding strength between them is enhanced. Moreover, the ink in the flow passage unit 2 comes into contact with the diaphragm 30, which is made from stainless steel having superior corrosion resistance to ink, and the flow passage unit 2. Therefore, there will be no chance of a local battery being formed in the flow passage unit 2 or the diaphragm 30, regardless of the ink selected. Since selection of ink is not limited in consideration of corrosion, the degree of freedom of ink selection is increased.

The piezoelectric layer 31 containing, as the main ingredient, lead zirconate titanate (PZT) which is a solid solution of lead titanate and lead zirconate and which is ferroelectric is formed on the surface of the diaphragm 30. This piezoelectric layer 31 is formed continuously across the plurality of pressure chambers 14 without clearance there between. For this reason, the piezoelectric layer 31 can be formed for all of the pressure chambers 14 at one time, thereby facilitating formation of the piezoelectric layer 31. The piezoelectric layer 31 can be formed by use of, e.g., the aerosol deposition method (AD method) which causes ultrafine material particles to collide against each other at high speed, to thus deposit the material. Other methods that can be used include the sol-gel method, the sputtering method, the hydrothermal synthesis method, and the CVD (Chemical Vapor Deposition) method. Further, a piezoelectric sheet obtained by sintering a green sheet of PZT can also be caused to adhere to the surface of the diaphragm 30, thereby forming the piezoelectric layer 31. As shown in FIGS. 3 to 5, an insulating material layer 34 is formed between the diaphragm 30 and the piezoelectric layer 31 in the areas where the pressure chambers 14 are formed and which do not overlap the individual electrodes 32, in perspective plan view. The insulating material layer 34 will be described in detail later.

The plurality of individual electrodes 32, each of which assumes the shape of an oval plane smaller than the pressure chamber 14, are formed in the surface of the piezoelectric layer 31. These individual electrodes 32 are formed at positions overlapping the respective center portions of the corresponding pressure chambers 14 in perspective plan view. The individual electrodes 32 are formed from a conductive material such as gold. A plurality of wiring sections 35 extend on the surface of the piezoelectric layer 31 from single end portions of the plurality of individual electrodes 32 (the right end portions in FIG. 2) in parallel to the direction of the long axis of the individual electrode 32. Terminal sections 36 are formed at the respective ends of the plurality of wiring sections 35. As mentioned previously, the piezoelectric layer 31 is formed continuously across the plurality of pressure chambers 14. Hence, the plurality of individual electrodes 32 and the plurality of wiring sections 35 connected to the plurality of individual electrodes 32 can be formed by a single operation, by means of printing conductive paste on the surface of the piezoelectric layer 31. A plurality of terminal sections 36 corresponding to the plurality of individual electrodes 32 are electrically connected to a driver IC 37 which selectively supplies a drive voltage to the plurality of individual electrodes 32. The driver IC 37 is placed on the surface of the diaphragm 30 by way of an unillustrated insulating material layer. Moreover, a plurality of connection terminals 40 are also formed on the diaphragm 30, and the driver 37 and a controller (not shown) which controls the driver IC 37 are connected to each other by way of the connection terminals 40.

Operation of the piezoelectric actuator 3 performed during ejection of ink will now be described.

When a drive voltage is selectively supplied from the driver IC 37 to the plurality of individual electrodes 32 connected to the driver IC 37 by way of the plurality of wiring sections 35, the individual electrodes 32 on the upper side of the piezoelectric layer 31 supplied with the drive voltage become different in electric potential from the diaphragm 30 which is held at a ground potential and provided on the lower side of the piezoelectric layer 31 and which acts as a common electrode. An electric field vertically develops in the area of the piezoelectric layer 31 (a drive section 31a) sandwiched between the individual electrode 32 and the diaphragm 30. As a result, of the piezoelectric layer 31, the drive section 31*a* located immediately below the individual electrode 32 supplied with the drive voltage contracts in a horizontal direction orthogonal to the vertical direction, which is a polarizing direction. In association with contraction of the drive section 31*a*, a surrounding section 31*b* is also deformed. As indicated by a chain line shown in FIG. 5, the area of the piezoelectric layer 31 and that of the diaphragm 30, both of which oppose the pressure chamber 14, are deformed so as to become convex toward the pressure chamber 14. As a result, the internal volume of the pressure chamber 14 is decreased, which in turn increases the pressure of ink. Ink is ejected from the nozzle 20 that is in mutual communication with the pressure chamber 14.

In association with contraction of the drive section 31*a*, the surrounding section 31*b* which is not subjected to the electric field and the area of the diaphragm 30 corresponding to the surrounding section 31*b* are also deformed. However, when the piezoelectric layer 31 is formed to a uniform thickness across the plurality of pressure chambers 14 without clearance, the rigidity of the piezoelectric actuator 3 in the area surrounding the drive section 31*a* is high, and the piezoelectric layer 31 and the diaphragm 30, both of which oppose the pressure chamber 14, are less deformed. For this reason, in the piezoelectric actuator 3 of the present embodiment, the insulating material layer 34 (a rigidity reduction section) is formed between the diaphragm 30 and the piezoelectric layer 31 and in the area where the pressure chamber 14 is formed and the insulating material layer does not overlap the individual electrode 32 in perspective plan view, so as to surround the individual electrode 32. The insulating material layer 34 is formed from synthetic resin whose elastic modulus is lower than that of the diaphragm 30 and that of the piezoelectric layer 31 (e.g., elastic modulus is about one-twentieth that of the diaphragm 30 and one-tenth that of the piezoelectric layer 31), such as polyimide or the like. The insulating material layer 34 can be formed over the surface of the diaphragm 30 by a single operation by means of screen printing or the like.

As mentioned above, the insulating material layer 34 which is lower in elastic modulus than the diaphragm 30 and the piezoelectric layer 31 is provided between the diaphragm 30 and the surrounding section 31*b* of the piezoelectric layer 31. In this area, the diaphragm 30 and the piezoelectric layer 31 remain out of direct contact with each other. Therefore, the diaphragm 30 and the piezoelectric layer 31 exist not as an integrated layer, but as two separate layers within the area where the insulating material layer 34 is provided. The flexural rigidity of the plate material is proportional to the cube of plate thickness. Therefore, when compared with a case where the diaphragm 30 and the piezoelectric layer 31 form an integrated layer, the rigidity of the piezoelectric actuator 3 in the area surrounding the drive section 31*a* becomes lower. Accordingly, when the drive section 31*a* is deformed through extension and contraction, the piezoelectric layer 31 and the diaphragm 30, both of which are located in the area opposing the pressure chamber 14, are easily deformed and can be efficiently deformed at a low voltage.

As mentioned previously, the piezoelectric layer 31 can be formed by various methods such as the AD method, the sol-gel method, the sputtering method, the hydrothermal synthesis method, the CVD (Chemical Vapor Deposition) method, or a method for affixing a piezoelectric sheet. However, in a state where the insulating material layer 34 is formed on the surface of the diaphragm 30, the surface of the diaphragm 30 remains irregular. For this reason, in order to bring the piezoelectric layer 31 into intimate contact with the surface of the diaphragm 30, the piezoelectric layer 31 is most preferably formed by the AD method, which enables formation of a layer by causing ultrafine material particles to collide against each other at high speed, to thus deposit the material. Another preferable method for forming the piezoelectric layer 31 is the sputtering method, which enables formation of a layer by causing an inactive gas to collide against a target, to thus deposit atoms and molecules spun out of the target.

Next, a modification achieved by means of various additions to the embodiment will now be described. However, those elements which have the same configurations as those of the present embodiment are assigned the same reference numerals, and their explanations are omitted, as appropriate.

Figure 6:
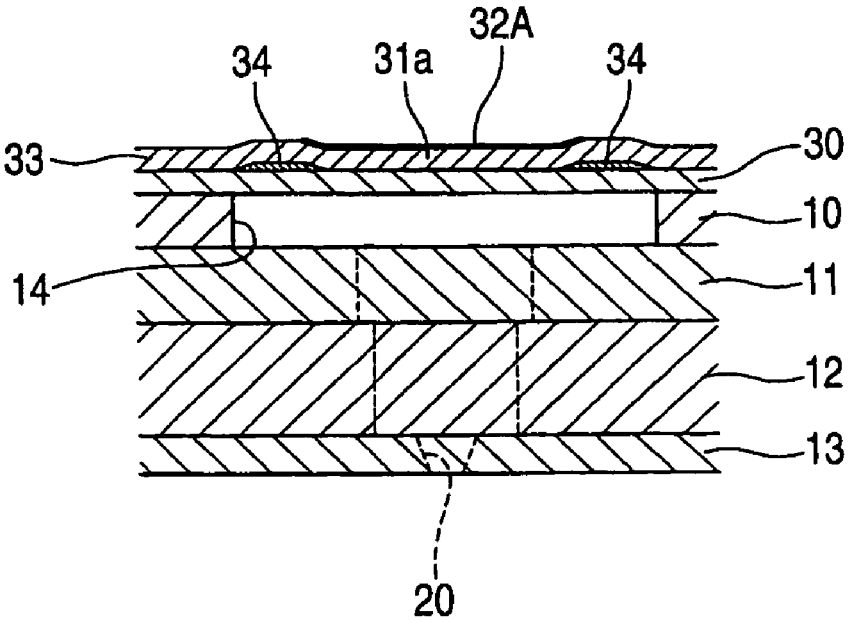
FIG. 6 is a view corresponding to a modification of the inkjet head shown in FIG. 5.

1] As shown in FIG. 6, an individual electrode 32A may be formed so as to partially overlap the insulating material layer 34. In this case, even when the pattern of the individual electrodes 32A has become slightly offset from the plurality of pressure chambers 14 on the surface of the piezoelectric layer 31, the drive section 31*a* of the piezoelectric layer 31 sandwiched between the individual electrode 32A and the diaphragm 30 is prevented from being offset from the pressure chamber 14 of the drive section 31*a*.

Figure 7:
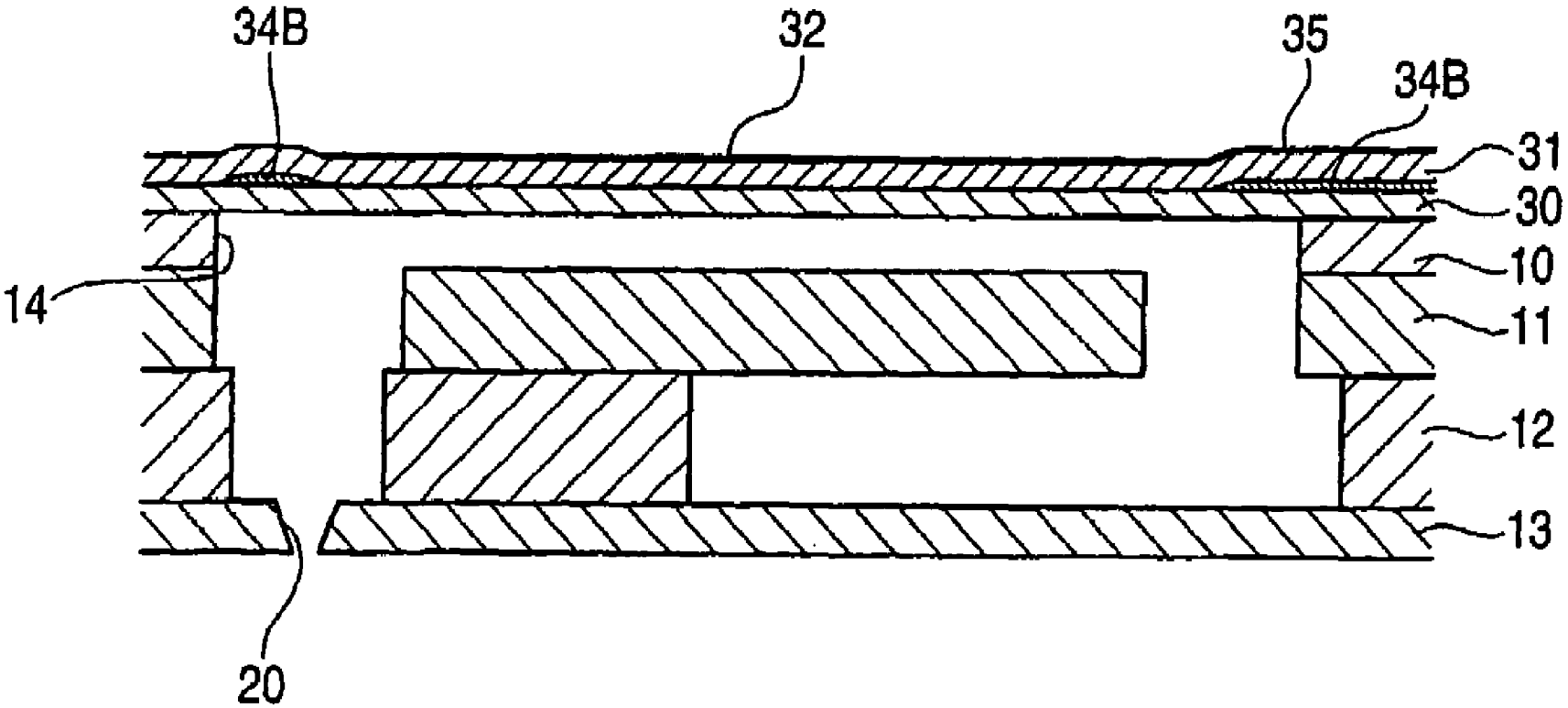
FIG. 7 is a view corresponding to another modification of the inkjet head shown in FIG. 4.

2] As shown in FIG. 7, an insulating material layer 34B may be formed so as to extend over the area where no pressure chamber 14 is formed, below the wiring section 35. In this case, when the drive voltage is supplied to the individual electrode 32, occurrence of electrostatic capacitance between the wiring section 35 connected to the individual electrode 32 and the diaphragm 30 can be prevented. The insulating material layer 34B maybe formed so as to be continuous with an insulating material layer (not shown) interposed between the previously-described driver IC 37 (see FIG. 2) and the diaphragm 30.

Figure 8:
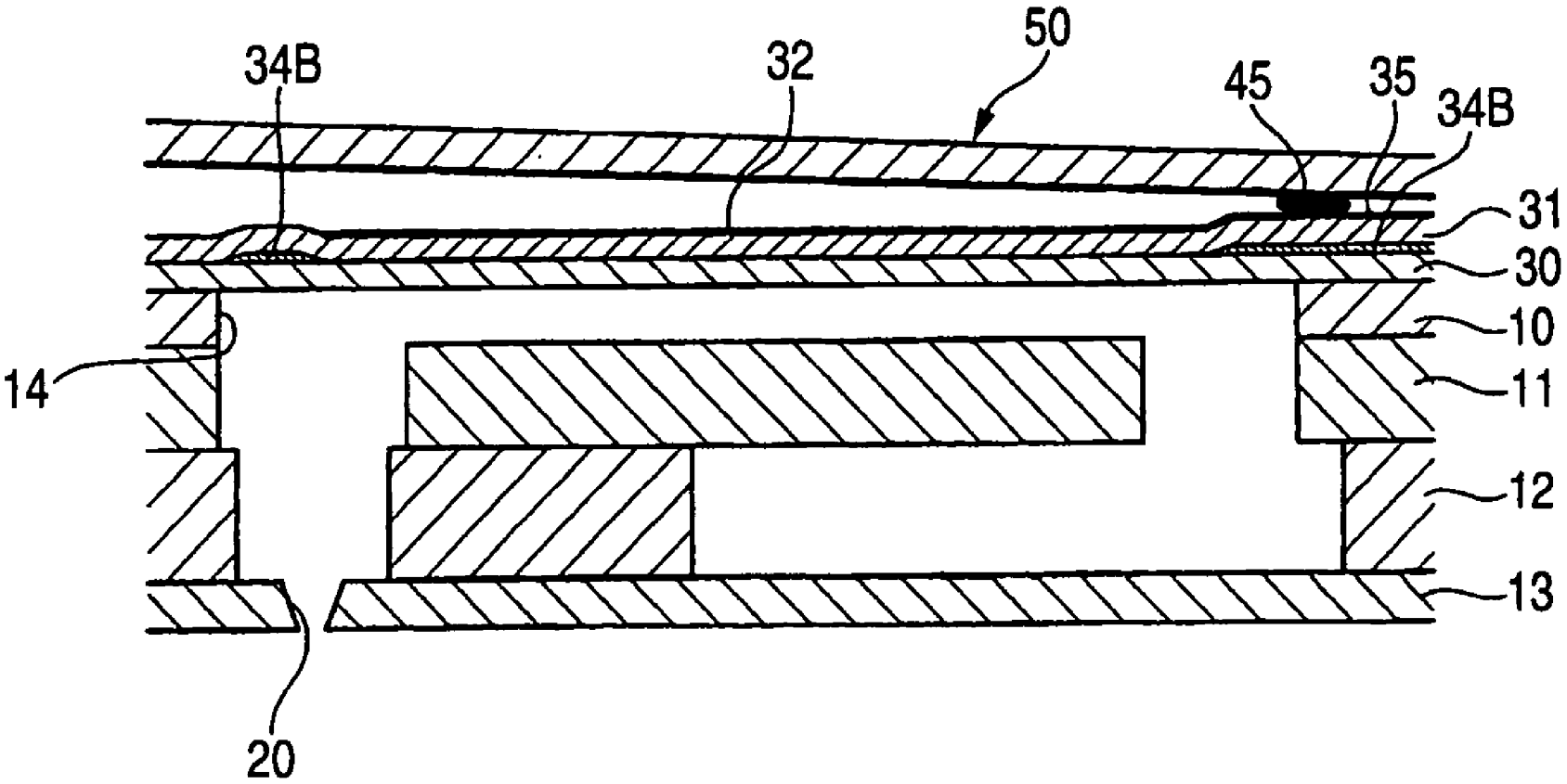
FIG. 8 is a view corresponding to still another modification of the inkjet head shown in FIG. 4 when a wiring member is connected to the head.

Further, as shown in FIG. 8, the plurality of individual electrodes 32 and the driver IC 37 (see FIG. 2) can be connected together by way of a wiring member 50 such as a flexible printed wiring board (Flexible Printed Circuit: FPC). In this case, when a bump 45 (a contact point section) for electrically connecting the individual electrode 32 to the wiring member 50 is formed in the wiring section 35 located in the area where the wiring section 35 overlaps the insulating material layer 34B, concentration of stress on the piezoelectric layer 31 is lessened by the insulating material layer 34B having low rigidity when the wiring member 50 is electrically connected to the bump 45, by pressing the wiring member 50 against the bump 45, thereby minimizing infliction of damage to the piezoelectric layer 31.

Figure 9:
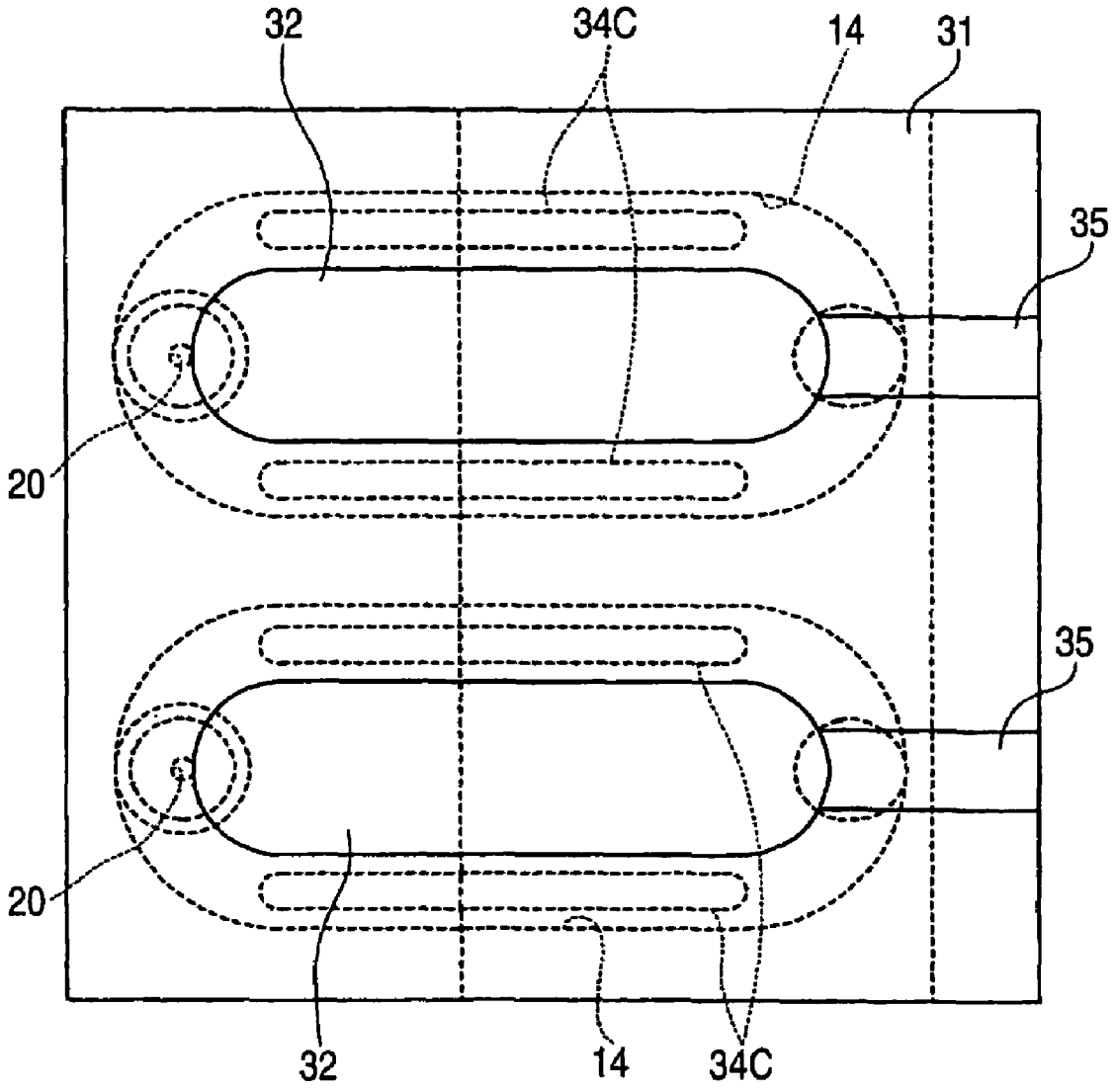
FIG. 9 is a view corresponding to still another modification of the inkjet head shown in FIG. 3.

3] The insulating material layer does not necessarily need to be formed so as to surround the individual electrode. For instance, as shown in FIG. 9, two insulating material layers 34C extending in the direction of the long axis of each individual electrode 32 maybe formed on the respective sides of the individual electrode 32.

Figure 10:
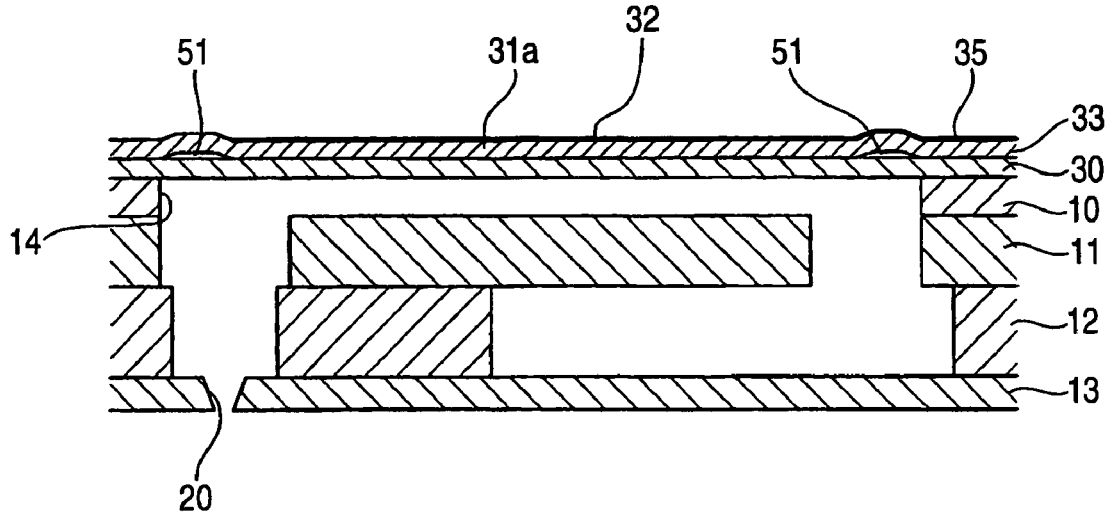
FIG. 10 is a view corresponding to a modification of the inkjet head shown in FIG. 4 where a void is formed.
Figure 11:
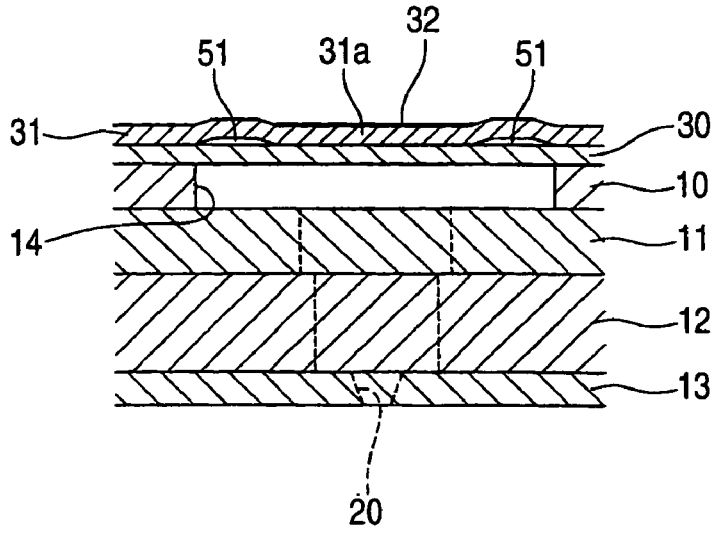
FIG. 11 is a view corresponding to a modification of the inkjet head shown in FIG. 5 where a void is formed.

4] A void may be formed between the diaphragm 30 and the piezoelectric layer 31 in place of the insulating material layers 34, 34B, and 34C of the embodiment and the modification thereof. For instance, as shown in FIGS. 10 and 11, a void 51 may be formed between the diaphragm 30 and the piezoelectric layer 31 so as to surround the individual electrode 32 in the area where the pressure chamber 14 is formed and the void does not overlap the individual electrode 32, when viewed in plane. Here, in order to form the void 51 between the diaphragm 30 and the piezoelectric layer 31, there can be adopted, e.g., a method for applying resist over an area on the diaphragm 30 where the void 51 is to be formed and dissolving the resist with a solvent after formation of the piezoelectric layer 31 on the surface of the resist. In an area surrounding the drive section 31*a* where the void 51 is formed, the diaphragm 30 is separated from the piezoelectric layer 31. Hence, the rigidity of the piezoelectric actuator in the area surrounding the drive section 31*a* is lowered, so that the piezoelectric layer 31 and the diaphragm 30, both of which oppose the pressure chamber 14, are easily deformed. Moreover, the electric field does not act on the piezoelectric layer 31 in the area where the void 51 is provided, and hence there can also be prevented occurrence of unwanted electrostatic capacitance between the individual electrode 32, the wiring section 35 connected to the individual electrode 32, and the diaphragm 30.

Figure 12:
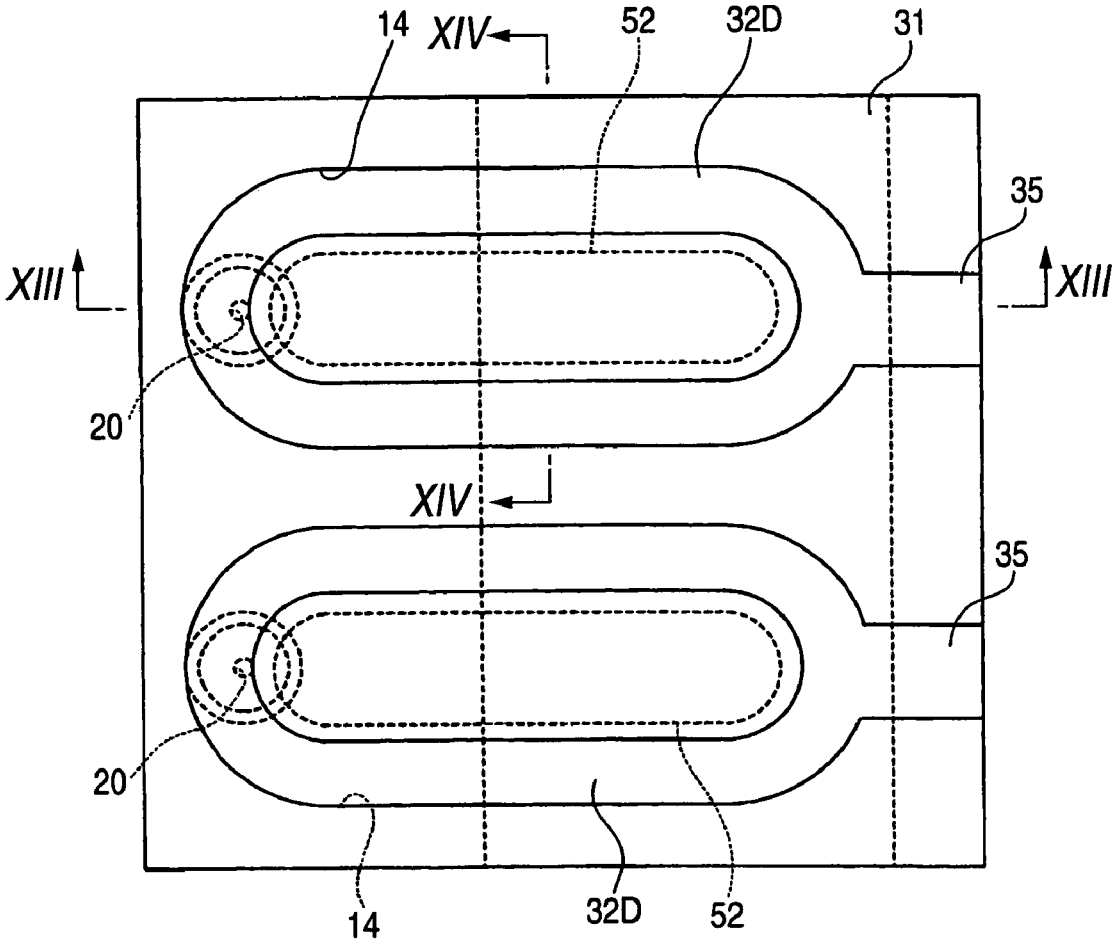
FIG. 12 is a view corresponding to the modification of the inkjet head shown in FIG. 3 where a rigidity reduction section is formed in the center thereof.
Figure 13:
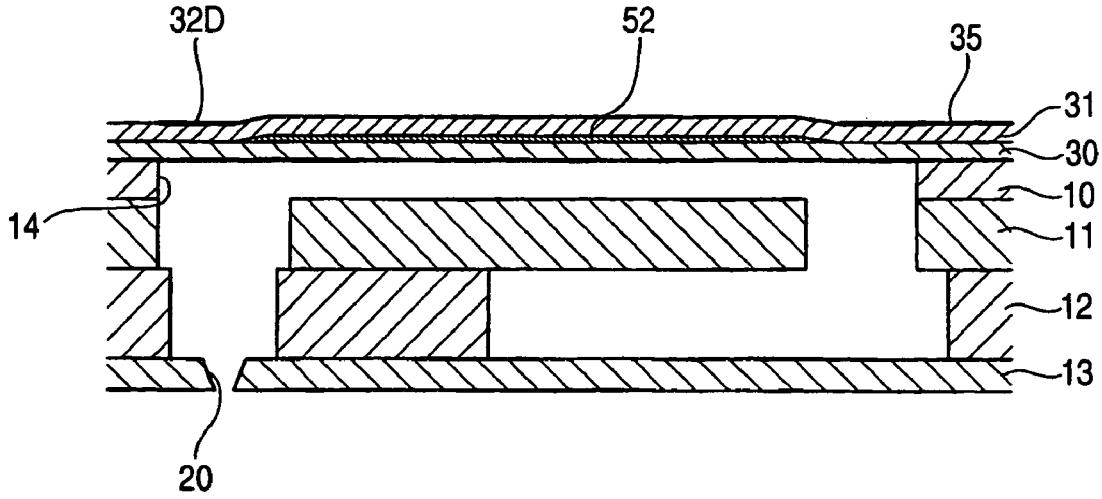
FIG. 13 is across-sectional view taken along line XIII-XIII shown in FIG. 12.
Figure 14:
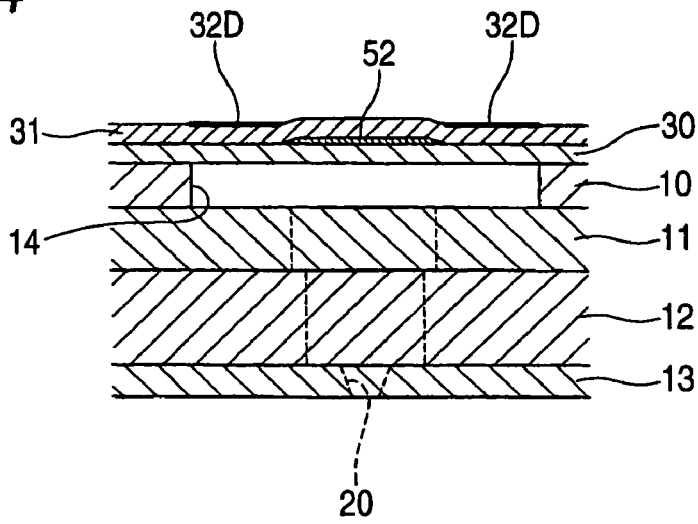
FIG. 14 is a cross-sectional view taken along line XIV-XIV shown in FIG. 12.

5] In the embodiment, the individual electrode 32 is formed in the center of the area where the pressure chamber 14 is formed, when viewed in plane. For instance, as shown in FIGS. 12 to 14, an individual electrode 32D may be formed in the form of an oval ring along an edge of the area where the pressure chamber 14 is formed, and an oval rigidity reduction section 52 made of an insulating material layer or a void may be formed in an inner area of the individual electrode 32D. Even in this case, a drop arises in the rigidity of the piezoelectric actuator in the area where the rigidity reduction section 52 is formed, at the center of the area where the pressure chamber 14 is formed. Hence, the piezoelectric layer 31 and the diaphragm 30, both of which oppose the pressure chamber 14, are easily deformed.

6] In the embodiment, the diaphragm 30 having conductivity doubles as a common electrode. However, the common electrode may be formed on the surface of a non-conductive diaphragm such as a glass material or the like. Moreover, a plurality of individual electrodes may be formed on the upper side of the diaphragm, and the common electrode may be formed on the surface of the piezoelectric layer. However, when the plurality of individual electrodes are formed on the upper side of the conductive diaphragm, an insulation layer for insulating the plurality of individual electrodes from each other must be interposed between the diaphragm and the individual electrodes.

Figure 15:
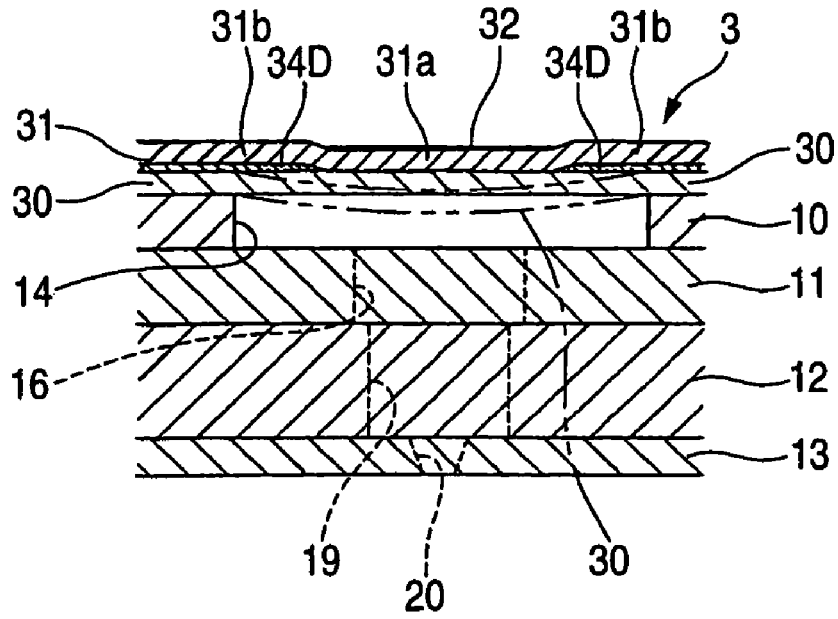
FIG. 15 is a view corresponding to still another modification of the inkjet head shown in FIG. 5.

7] As shown in FIG. 15, an insulating material layer 34D may be formed so as to extend up to the area where no pressure chamber 14 is formed, not necessarily below the wiring section. The insulating material layer 34D may extend over the area below the wiring section and the area not below the wiring section.

Figure 16:
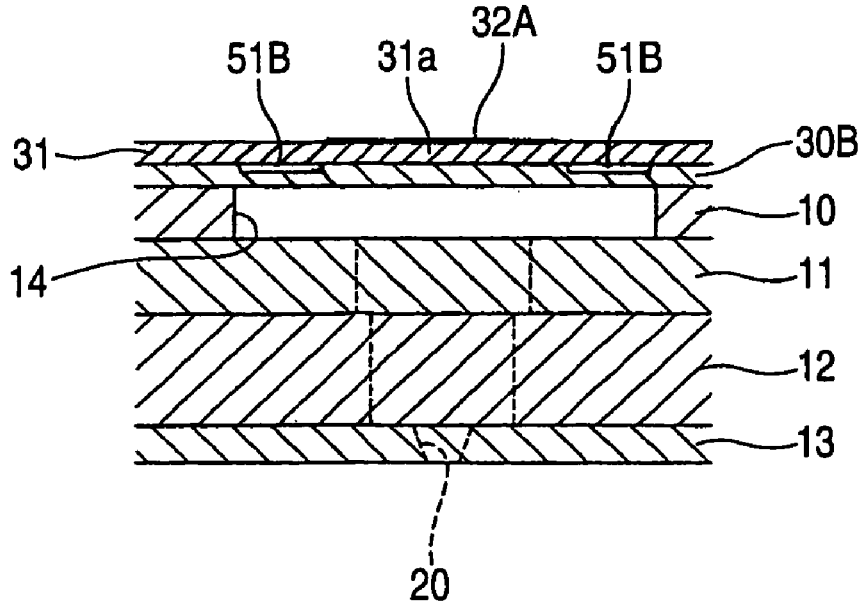
FIG. 16 is a view corresponding to still another modification of the inkjet head shown in FIG. 5.

8] As shown in FIG. 16, a diaphragm 30B may be formed with a recess so that a void 51B is defined by the diaphragm 30B and the piezoelectric layer 31. For example, the recess can be formed by patterning a resist layer on the surface of the diaphragm 30B and then applying etching solution. In a case where the thickness of the diaphragm 30B is about 20-30 μm, the depth of the recess may be set to about 8-10 μm.

Additionally, it is preferable to fill the void 51B with an insulating material that serves as a low elasticity material. The insulating material can be left only in the recess by applying the insulating material on the diaphragm 30B after forming the recess on the diaphragm 30B and then scraping it by a blade or the like. By providing the piezoelectric layer on the diaphragm 30B thus filled with the insulating material in its recess, the void 51B can be filled with the insulating material.

Figure 17:
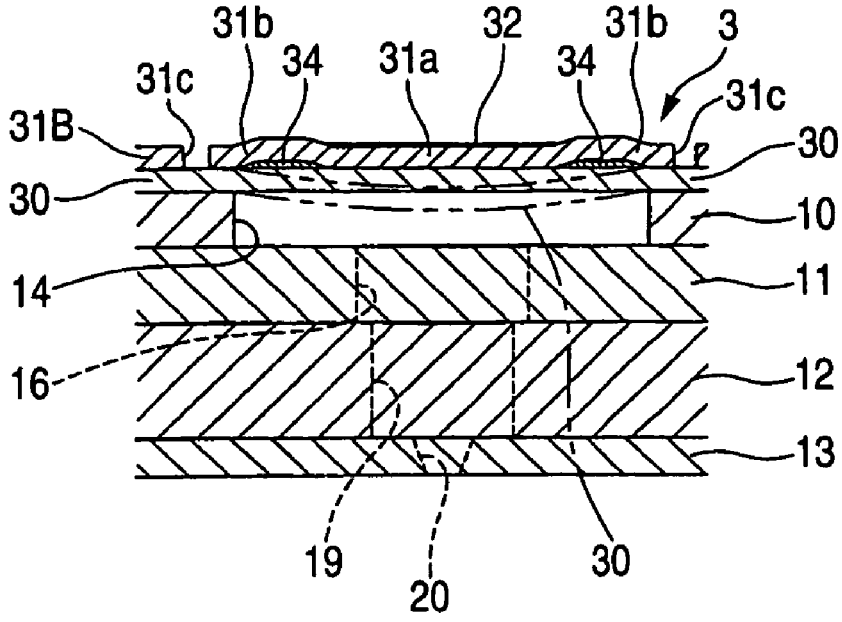
FIG. 17 is a view corresponding to still another modification of the inkjet head shown in FIG. 5.

9] As shown in FIG. 17, a piezoelectric layer 31B may be cut on the surface of the diaphragm 30. For example, between a portion of the piezoelectric layer 31B on one pressure chamber 14 and a portion of the piezoelectric layer 31B on the adjacent pressure chamber 14, a groove 31*c* that exposes the diaphragm 30 to the outside may be formed. In a case where the thickness of the piezoelectric layer 31B is about 10 μm, the width of the groove 31*c* maybe set to about 20 μm. The groove 31*c* is preferably formed by laser cutting, however, the way to form the groove 31*c* is not limited to it. For example, in a state where a resist is deposited on a portion of the diaphragm's surface to be formed with the groove 31*c*, the piezoelectric layer 31B is deposited on the other portion of the diaphragm's surface. Then, by removing the resist, the groove 31*c* can be formed.

Figure 18:
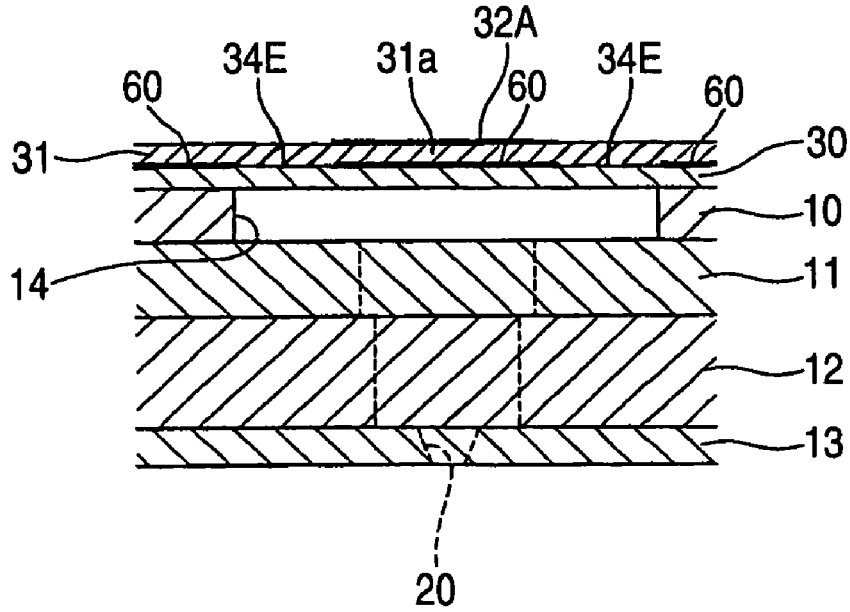
FIG. 18 is a view corresponding to still another modification of the inkjet head shown in FIG. 5.

10] As shown in FIG. 18, in this example, the piezoelectric layer 31 and the diaphragm 30 are partially bonded to each other, and the portions which are not bonded serve as a rigidity reduction section 34E. The thickness of the adhesive may be set to about 1 μm. For example, epoxy adhesive is pattern-applied on the surface of the diaphragm 30 by screen printing and then the piezoelectric layer 31 is placed on the diaphragm 30 and bonded to it.

Figure 19:
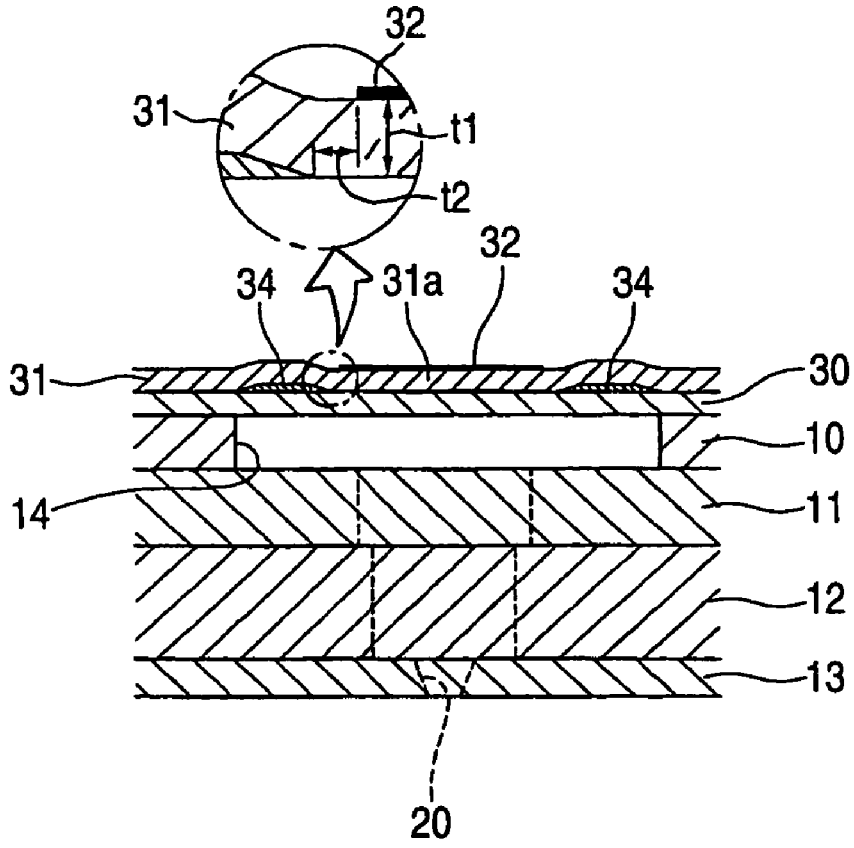
FIG. 19 is a view corresponding to still another modification of the inkjet head shown in FIG. 5.

11] Incidentally, as shown in FIG. 19, a distance t2 between an end portion of the rigidity reduction section 34 and an end of the individual electrode 32 along a direction of the surface of the diaphragm 30 (an interval between the rigidity reduction section 34 and the individual electrode 32 in perspective plan view) is preferably se to be smaller than the thickness t1 of the piezoelectric layer 31.

Figure 20:
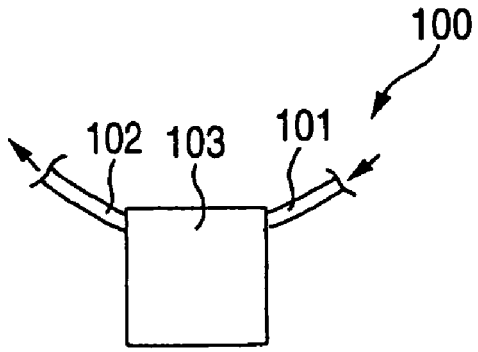
FIG. 20 shows an example where the invention is applied to a pump.

12] In the above-described embodiment, the invention is applied to the inkjet head. The invention is not limited therein. For example, as shown in FIG. 20, the invention is applicable to a pump 100 that has a liquid introduction port 101, a liquid ejection port 102 and a pump main body 103. Inside the pump main body 103, a flow passage unit and a piezoelectric actuator are disposed. The configuration of the piezoelectric actuator may be the same as that of the above-described embodiment. The pump 100 can deliver, for example, living body solution.

The liquid delivering device according to the invention can deliver liquid such as ink and living body solution thus described, drug solution, electrically conductive solution as wire material, organic EL resin and the like.

What is claimed is:

1. A liquid delivering device comprising:

a flow passage unit having a plurality of pressure chambers each of which communicating with a liquid ejection port;

a piezoelectric actuator for selectively changing the volume of the plurality of pressure chambers, the piezoelectric actuator including a plurality of individual electrodes corresponding to the plurality of pressure chambers, a common electrode opposing the plurality of individual electrodes, a piezoelectric layer sandwiched between the plurality of individual electrodes and the common electrode, and a rigidity reduction structure configured to reduce the rigidity of the piezoelectric actuator and which is provided within an area where at least the pressure chamber is formed and in a vicinity of the individual electrode, in perspective plan view, wherein the piezoelectric layer is disposed to cover, in perspective plan view, at least each region that corresponds to an entire portion of each of the pressure chambers, wherein the rigidity reduction structure reduces the rigidity of a partial area, in perspective plan view, of the piezoelectric actuator corresponding to each of the pressure chambers, wherein the rigidity reduction structure is provided inside of the piezoelectric actuator and is not exposed outside, and wherein the rigidity reduction structure does not overlap the individual electrode, or only a part of the rigidity reduction structure overlaps the individual electrode, in perspective plan view.

2. The liquid delivering device according to claim 1, wherein the piezoelectric layer is formed continuously across the plurality of pressure chambers.

3. The liquid delivering device according to claim 2, wherein the piezoelectric layer is formed by an aerosol deposition method, a CVD method, or a sputtering method.

4. The liquid delivering device according to claim 1, wherein the piezoelectric actuator comprises a diaphragm having a surface, the diaphragm acting as the common electrode or on the surface of the diaphragm the plurality of individual electrodes or the common electrode is located, and wherein the rigidity reduction structure is provided between the diaphragm and the piezoelectric layer.

5. The liquid delivering device according to claim 4, wherein the rigidity reduction structure forms a void located between the diaphragm and the piezoelectric layer.

6. The liquid delivering device according to claim 5, wherein the void is defined by a surface of the piezoelectric layer and a recess provided on the surface of the diaphragm.

7. The liquid delivering device according to claim 5, wherein the rigidity reduction structure is formed by filling a void defined by a surface of the piezoelectric layer and a recess provided on the surface of the diaphragm with a low elasticity material which is lower in elastic modulus than the diaphragm and the piezoelectric layer.

8. The liquid delivering device according to claim 4, wherein the rigidity reduction structure includes a low elasticity material which is lower in elastic modulus than the diaphragm and the piezoelectric layer.

9. The liquid delivering device according to claim 8, wherein the low elasticity material is an insulating material.

10. The liquid delivering device according to claim 4, wherein a contact point section, configured to electrically connect the plurality of individual electrodes to a wiring member that supplies a drive voltage to the plurality of individual electrodes, is located in an area which overlaps the rigidity reduction structure in perspective plan view.

11. The liquid delivering device according to claim 1, wherein the liquid ejection port is configured to object liquid.

12. The liquid delivering device according to claim 11, wherein the liquid ejection port is configured to eject ink.

13. The liquid delivering device according to claim 1, wherein the piezoelectric layer is formed by a separate piezoelectric section for each of the plurality of pressure chambers.

14. The liquid delivering device according to claim 1, wherein the rigidity reduction structure includes a low elasticity material which is lower in elastic modulus than the diaphragm and the piezoelectric layer.

15. The liquid delivering device according to claim 1, wherein at least one of the plurality of individual electrodes is disposed, in plan view, to cover a center portion corresponding to at least one of the plurality of pressure chambers, and wherein the rigidity reduction structure is provided within an area where the at least one pressure chamber is located and outside the at least one individual electrode.

16. The liquid delivering device according comprising:

a flow passage unit having a plurality of pressure chambers each of which communicating with a liquid ejection port;

a piezoelectric actuator configured to selectively change the volume of the plurality of pressure chambers, the piezoelectric actuator including a plurality of individual electrodes corresponding to the plurality of pressure chambers, a common electrode opposing the plurality of individual electrodes, a piezoelectric layer sandwiched between the plurality of individual electrodes and the common electrode, and a rigidity reduction structure configured to reduce the rigidity of the piezoelectric actuator and which is provided in an area where at least the pressure chamber is located and in a vicinity of the individual electrode, in perspective plan view, wherein the piezoelectric layer is disposed to cover, in perspective plan view, at least each region that corresponds to an entire portion of each of the pressure chambers, wherein the rigidity reduction structure reduces the rigidity of a partial area, in perspective plan view, of the piezoelectric actuator corresponding to each of the pressure chambers, wherein the rigidity reduction structure is provided inside of the piezoelectric actuator and is not exposed outside, wherein the piezoelectric actuator comprises a diaphragm having a surface, the diaphragm acting as the common electrode or on the surface of the diaphragm the plurality of individual electrodes or the common electrode is located, wherein the rigidity reduction structure is provided between the diaphragm and the piezoelectric layer, and wherein the rigidity reduction structure is located up to an area where no pressure chambers are formed in perspective plan view.

17. The liquid delivering comprising:

a flow passage unit having a plurality of pressure chambers each of which communicating with a liquid ejection port;

a piezoelectric actuator configured to selectively change the volume of the plurality of pressure chambers, the piezoelectric actuator including a plurality of individual electrodes corresponding to the plurality of pressure chambers, a common electrode opposing the plurality of individual electrodes, and a piezoelectric layer sandwiched between the plurality of individual electrodes and the common electrode; and a rigidity reduction section which reduces the rigidity of the piezoelectric actuator and which is provided in an area where at least the pressure chamber is located and in a vicinity of the individual electrode, in perspective plan view, wherein the piezoelectric layer has a groove in an area located between the pressure chambers in perspective plan view, the diaphragm being exposed through the groove.

18. The liquid delivering device comprising:

a flow passage unit having a plurality of pressure chambers each of which communicating with a liquid ejection port;

a piezoelectric actuator configured to selectively change the volume of the plurality of pressure chambers, the piezoelectric actuator including a plurality of individual electrodes corresponding to the plurality of pressure chambers, a common electrode opposing the plurality of individual electrodes, and a piezoelectric layer sandwiched between the plurality of individual electrodes and the common electrode; and a rigidity reduction section which reduces the rigidity of the piezoelectric actuator and which is provided in an area where at least the pressure chamber is located and in a vicinity of the individual electrode, in perspective plan view, wherein the piezoelectric layer and the diaphragm are partially bonded to each other and portions of the piezoelectric layer and the diaphragm which are not bonded act as the rigidity reduction section, and wherein the rigidity reduction structure does not overlap the individual electrode, or only a part of the rigidity reduction structure overlaps the individual electrode, in perspective plan view.

19. The liquid delivering device according to claim 18, wherein at least one of the plurality of individual electrodes is disposed, in plan view, to cover a center portion corresponding to at least one of the plurality of pressure chambers, and wherein the rigidity reduction structure is provided within an area where the at least one pressure chamber is located and outside the at least one individual electrode.

20. A liquid delivering device comprising:

a flow passage unit having a plurality of pressure chambers each of which communicating with a liquid ejection port;

a piezoelectric actuator configured to selectively change the volume of the plurality of pressure chambers, the piezoelectric actuator including a plurality of individual electrodes corresponding to the plurality of pressure chambers, a common electrode opposing the plurality of individual electrodes, a piezoelectric layer sandwiched between the plurality of individual electrodes and the common electrode, and a rigidity reduction structure configured to reduce the rigidity of the piezoelectric actuator and which is provided within an area where at least the pressure chamber is formed and in a vicinity of the individual electrode, in perspective plan view, wherein the piezoelectric layer is disposed to cover, in perspective plan view, at least each region that corresponds to an entire portion of each of the pressure chambers, wherein the rigidity reduction structure reduces the rigidity of a partial area, in perspective plan view, of the piezoelectric actuator corresponding to each of the pressure chambers, wherein the rigidity reduction structure is provided inside of the piezoelectric actuator and is not exposed outside, and wherein, when viewed in a direction orthogonal to the plane, the rigidity reduction structure is provided between at least a portion of the piezoelectric layer and at least one of the plurality of individual electrodes or between at least a portion of the piezoelectric layer and the common electrode.

21. The liquid delivering device according to claim 20, wherein the individual electrode partially overlaps the rigidity reduction structure in perspective plan view.

22. A liquid delivering device comprising:

a flow passage unit having a plurality of pressure chambers each of which communicating with a liquid ejection port;

a piezoelectric actuator configured to selectively change the volume of the plurality of pressure chambers, the piezoelectric actuator including a plurality of individual electrodes corresponding to the plurality of pressure chambers, a common electrode opposing the plurality of individual electrodes, and a piezoelectric layer sandwiched between the plurality of individual electrodes and the common electrode, and a rigidity reduction structure configured to reduce the rigidity of the piezoelectric actuator and which is provided in an area where at least the pressure chamber is located and in a vicinity of the individual electrode, in perspective plan view, wherein the piezoelectric layer is disposed to cover, in perspective plan view, at least each region that corresponds to an entire portion of each of the pressure chambers, wherein the rigidity reduction structure reduces the rigidity of a partial area, in perspective plan view, of the piezoelectric actuator corresponding to each of the pressure chambers, wherein the rigidity reduction structure is provided inside of the piezoelectric actuator and is not exposed outside, wherein the piezoelectric actuator comprises a diaphragm having a surface, the diaphragm acting as the common electrode or on the surface of the diaphragm the plurality of individual electrodes or the common electrode is located, wherein the rigidity reduction structure is provided between the diaphragm and the piezoelectric layer, and wherein the rigidity reduction structure is provided to increase a distance, in a direction orthogonal to the plane, between the lower surface of the piezoelectric layer and the upper surface of the diaphragm.

* * * * *

UNITED STATES PATENT AND TRADEMARK OFFICE

CERTIFICATE OF CORRECTION

PATENT NO. : 7,654,649 B2
APPLICATION NO. : 11/167361
DATED : February 2, 2010
INVENTOR(S) : Hiroto Sugahara It is certified that error appears in the above-identified patent and that said Letters Patent is hereby corrected as shown below:

Title Page, (*) Notice: Delete "174 days" and insert --232 days--.

In Column 9, Claim 1, Line 34:
Please delete "actuator for selectively" and insert --actuator configured to selectively--.

In Column 9, Claim 1, Line 44:
Please delete "is formed and" and insert --is located and--.

In Column 10, Claim 11, Line 34:
Please delete "to object liquid" and insert --to eject liquid--.

In Column 10, Claim 13, Line 38:
Please delete "formed by a" and insert --formed of a--.

In Column 10, Claim 16, Line 52:
Please delete "The liquid" and insert --A liquid--.

In Column 10, Claim 16, Line 52:
Please delete "device according comprising:" and insert --device comprising:--.

In Column 10, Claim 16, Line 65:
Please delete "provided in an" and insert --provided within an--.

In Column 11, Claim 17, Line 21:
Please delete "The liquid" and insert --A liquid--.

In Column 11, Claim 17, Line 40:
Please delete "the diaphragm" and insert --a diaphragm--.

In Column 11, Claim 18, Line 42:
Please delete "The liquid" and insert --A liquid--.

Signed and Sealed this

Twenty-fourth Day of August, 2010

David J. Kappos

David J. Kappos
*Director of the United States Patent and Trademark Office*

In Column 12, Claim 20, Line 23:
Please delete "is formed and" and insert --is located and--.

In Column 12, Claim 22, Line 57:
Please delete "provided in an" and insert --provided within an--.